US007407237B2

(12) United States Patent
Bright

(10) Patent No.: US 7,407,237 B2
(45) Date of Patent: Aug. 5, 2008

(54) COMBINED MAGAZINE RACK AND TOILET PAPER HOLDER

(75) Inventor: Travis Bright, Flat Rock, NC (US)

(73) Assignee: Zenith Products Corp., New Castle, DE (US)

( * ) Notice: Subject to any disclaimer, the term of this patent is extended or adjusted under 35 U.S.C. 154(b) by 0 days.

(21) Appl. No.: 11/185,565

(22) Filed: Jul. 20, 2005

(65) Prior Publication Data

US 2007/0018544 A1 Jan. 25, 2007

(51) Int. Cl.
*A47B 67/02* (2006.01)

(52) U.S. Cl. ..... 312/242; 312/34.24; 312/294

(58) Field of Classification Search ..... 312/242, 312/245, 224, 227, 294, 138.1, 139.2, 34.8, 312/34.23, 34.24; 206/823, 389, 391; 242/560.3, 242/560, 560.1, 560.2; D6/520, 523
See application file for complete search history.

(56) References Cited

U.S. PATENT DOCUMENTS

| | | | | | |
|---|---|---|---|---|---|
| 94,016 | A | * | 8/1869 | Mayo et al. | 312/139.2 |
| 228,627 | A | * | 6/1880 | Gordon | 312/114 |
| 845,729 | A | * | 2/1907 | Berge | 312/139.2 |
| 948,521 | A | * | 2/1910 | Payne | 312/117 |
| 1,663,820 | A | * | 3/1928 | Sykes | 312/306 |
| 1,877,470 | A | * | 9/1932 | Mastrangelo et al. | 312/25 |
| 2,459,252 | A | * | 1/1949 | Strahan | 242/560.3 |
| 2,738,898 | A | * | 3/1956 | Lee | 221/35 |
| D184,049 | S | | 12/1958 | Gillard | |
| 3,211,504 | A | * | 10/1965 | Bump | 242/560 |
| 3,372,966 | A | * | 3/1968 | Duy | 312/334.36 |
| D214,839 | S | | 8/1969 | Louis | |
| D227,212 | S | | 6/1973 | Graham | |
| 3,851,938 | A | * | 12/1974 | McCowan et al. | 312/117 |
| 4,221,442 | A | * | 9/1980 | Harangozo | 312/294 |
| 4,361,368 | A | * | 11/1982 | Daniels | 312/321.5 |
| 4,375,874 | A | * | 3/1983 | Leotta et al. | 242/560 |
| 4,437,568 | A | * | 3/1984 | Hamblin | 206/223 |
| 5,248,105 | A | | 9/1993 | Cooker | |
| D358,052 | S | | 5/1995 | Carpenter | |
| D364,059 | S | | 11/1995 | Merriweather, Jr. | |
| D368,819 | S | | 4/1996 | Lemmon | |
| 5,526,943 | A | | 6/1996 | Thompson | |
| 5,570,938 | A | * | 11/1996 | Butler | 312/45 |
| 5,878,893 | A | | 3/1999 | Micienko | |
| 6,053,591 | A | * | 4/2000 | Kasanic | 312/297 |
| 6,302,350 | B1 | * | 10/2001 | Burrell et al. | 242/560 |
| D508,354 | S | * | 8/2005 | D'Agostino | D6/520 |
| 2004/0130245 | A1 | * | 7/2004 | Pinto | 312/34.23 |

* cited by examiner

*Primary Examiner*—James O Hansen
(74) *Attorney, Agent, or Firm*—Panitch Schwarze Belisario & Nadel LLP

(57) ABSTRACT

A storage unit for use in the bathroom combines a magazine rack with a toilet paper roll storage area. A door selectively conceals or provides access to the toilet paper storage area. In addition, a sliding plate provides the support surface for additional elements such as a coffee cup.

2 Claims, 3 Drawing Sheets

COMBINED MAGAZINE RACK AND TOILET PAPER HOLDER

BACKGROUND OF THE INVENTION

This application relates to a combination storage system for use in a bathroom, wherein a magazine rack is combined with a toilet paper holder, and a sliding door conceals the toilet paper holder.

The organization and storage of items within a bathroom environment proves challenging. Typically, toilet paper holders may be placed upon a stand, or mounted within a bathroom wall. In many bathrooms, separate magazine racks are utilized to store reading material. The use of the separate components has sometimes resulted in a cluttered appearance for many modern bathrooms.

While proposed combination elements have been described in various patents, none of these have been truly practical, or themselves aesthetically pleasing. As an example, one proposed system combines a magazine rack with a storage pin for holding a toilet paper roll. However, it would be desirable to provide a more aesthetically pleasing component.

SUMMARY OF THE INVENTION

In a disclosed embodiment of this invention, a combined storage element includes a magazine rack area, and an area for mounting toilet paper rolls on pins. The toilet paper roll area is selectively concealed by a sliding door. The sliding door makes the combined element more aesthetically pleasing.

In disclosed additional features of this invention, there are a pair of toilet paper roll mounts concealed by the door. Further, a sliding plate may be placed into the storage element and utilized to support additional elements such as a coffee cup.

These and other features of the present invention can be best understood from the following specification and drawings, the following of which is a brief description.

DETAILED DESCRIPTION OF THE PREFERRED EMBODIMENT

Figure 1:
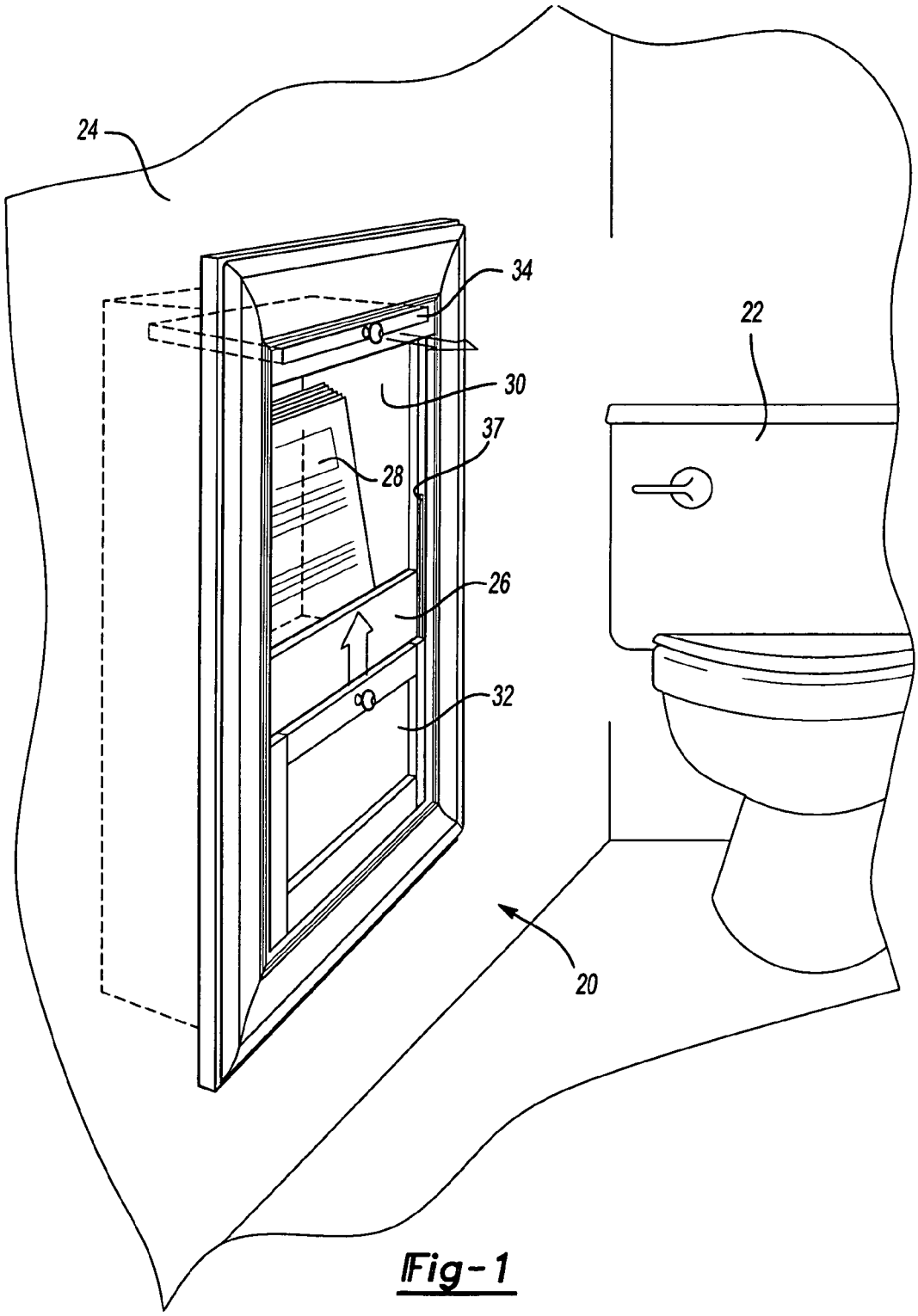
FIG. 1 shows the inventive storage unit mounted within a wall in a bathroom.

FIG. 1 shows a bathroom storage element 20 mounted adjacent to a toilet 22. As shown, the element 20 is mounted within a wall 24. A fence 26 holds magazines 28 within a magazine rack space 30. A sliding door 32 is mounted beneath the fence 26, and is selectively slidable vertically upwardly and downwardly, as will be explained below.

A plate 34 is slidable horizontally outwardly of the element 20 to provide an additional support surface as will be explained below.

Figure 2:
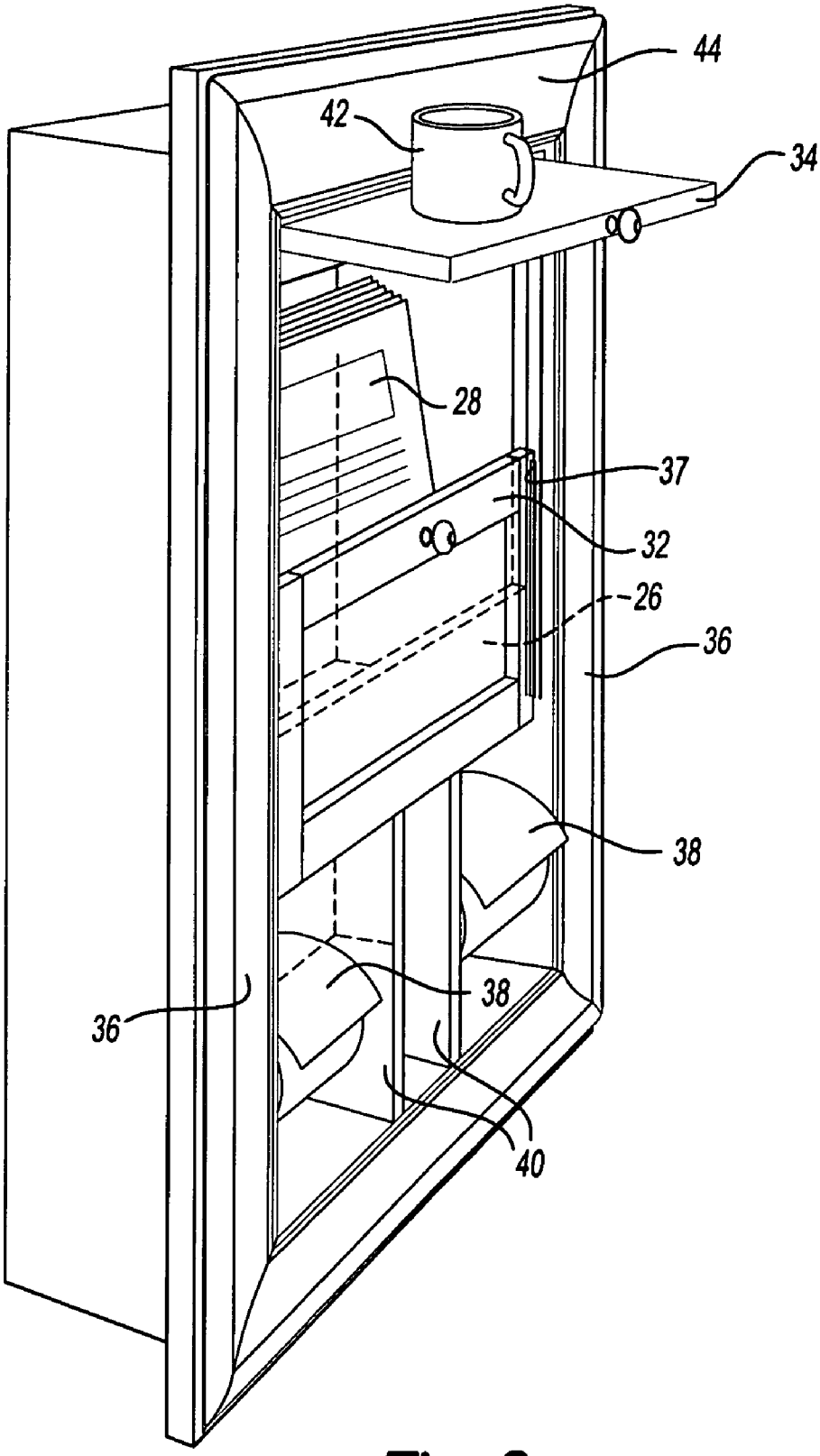
FIG. 2 is a perspective view of the inventive element.

As shown in FIG. 2, when the door 32 is slid vertically upwardly, toilet paper rolls 38 are exposed. These rolls are stored within spaces 40 beneath the fence 26. Side walls 36 carry tracks 37 that guide the door 32 for movement vertically upwardly. It should be understood that the guidance of the door 32 within the tracks 37 is such that the door 32 will remain stationary when it has been moved vertically upwardly, until the user moves it back vertically downwardly. As shown, even with the door 32 in its vertically upward position, magazines 28 are still accessible.

The plate 34 is shown slid horizontally outwardly to provide a support surface. In the disclosed embodiment, the support surface may support a coffee cup 42. An upper molding 44 is positioned above the plate 34.

Figure 3:
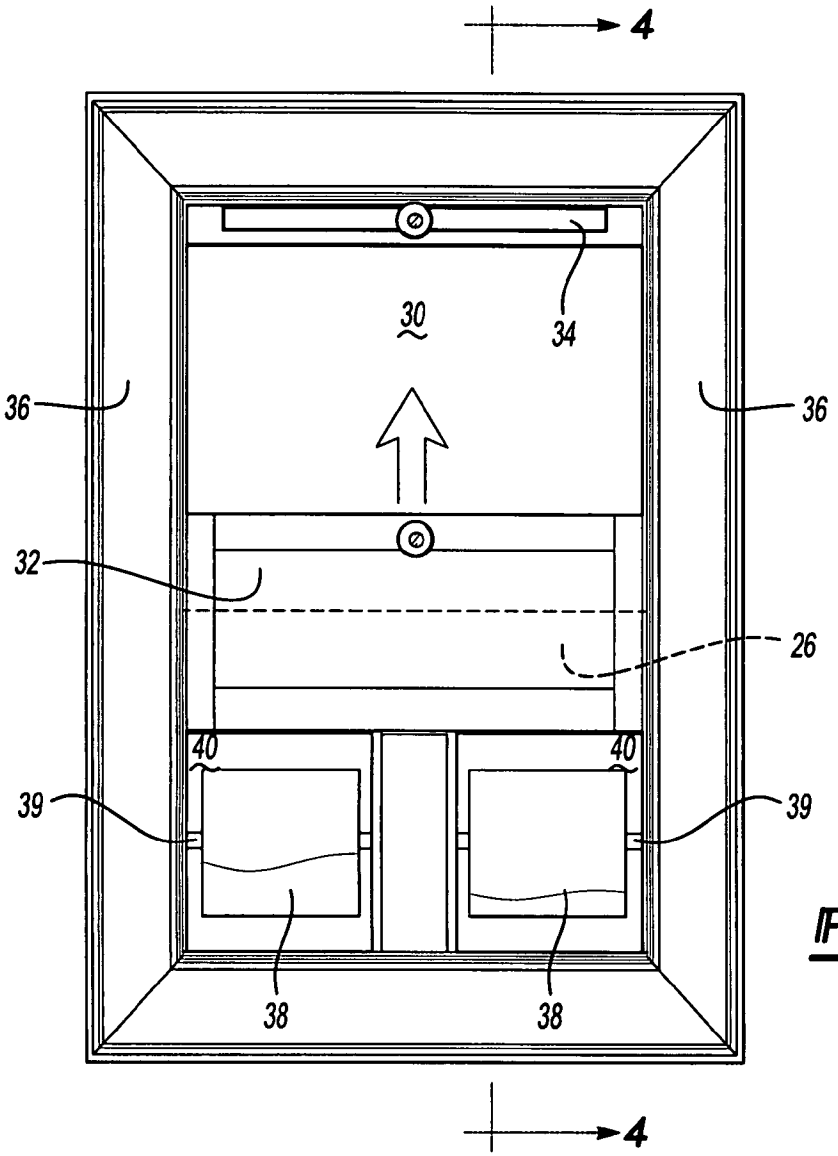
FIG. 3 is a front view of the inventive element.

As shown in FIG. 3, the toilet paper rolls 38 are mounted on pins 39 mounted within the storage spaces 40.

Figure 4:
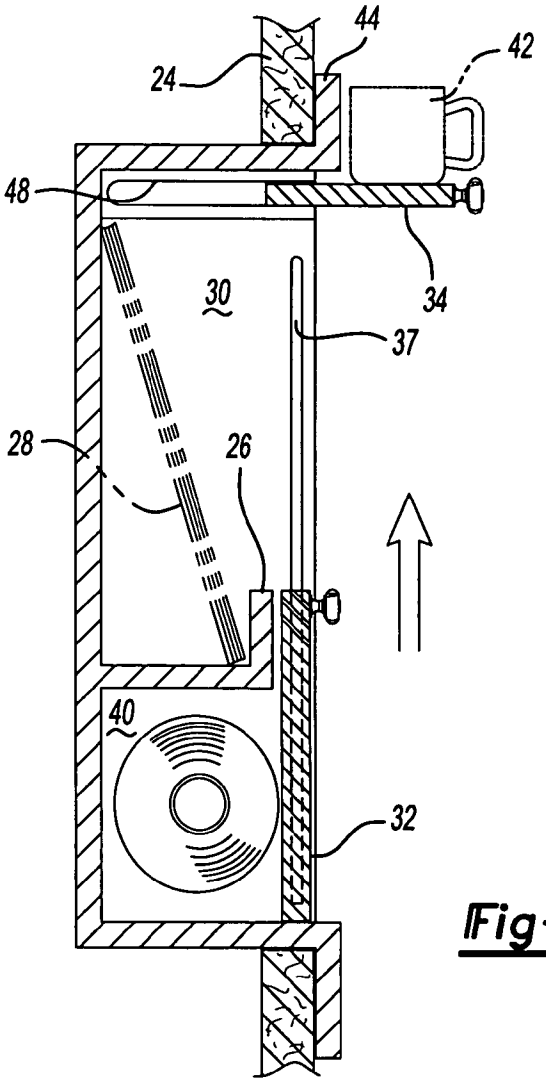
FIG. 4 is a cross-sectional view along line 4-4 of FIG. 3.

FIG. 4 is a cross-sectional view showing the combination of elements, and the storage element 20 mounted within the wall 24.

The door 32 is shown in FIG. 4 in a downwardly position, but the track 37 is shown. A worker of ordinary skill in the art would recognize how to provide an appropriate track that will hold the door at its upper position until moved back downwardly by an operator.

The present invention thus provides a more aesthetically pleasing storage element for use in a bathroom. By selectively concealing the toilet paper rolls, the combined storage element 20 is more aesthetically pleasing. Further, the use of the plate 34 provides additional functional features to a user, such as an ability to support additional component 42. As shown in FIG. 4, the plate 34 is slidable within a slot 48. As can be appreciated, the plate 34 is manufactured to be long enough, such that even when slid outwardly, it still will be able to support an element such as a coffee cup without tipping. Some stop will preferably be placed upon the plate 34 to prevent further movement outwardly.

While the combined unit 20 is shown mounted within a wall 24, it should be understood that similar features can be provided for a unit that is to be mounted onto a wall, rather than into a wall. In any configuration, it is preferred that the combined unit be easily mounted within the wall such as by anchors, screws, etc.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A combined magazine and toilet paper roll storage unit for use in a bathroom comprising:

a magazine storage area for receiving magazines and having a single hollow interior space in the form of a cuboid and a first open wall;

a toilet paper roll storage area including first and second toilet paper rolls and having a width generally equal to a width of the magazine storage area, the toilet paper roll storage area having a second open wall and being positioned beneath said magazine storage area, the first and second toilet paper rolls being removably mounted on respective first and second pins, the first and second pins having a common longitudinal axis;

a door generally parallel to the longitudinal axis of the first and second pins and selectively slidable over the first and second open walls, the door being slidable only in a direction generally orthogonal to the longitudinal axis of the first and second pins to conceal and provide access to said toilet paper roll storage area through the second open wall, the door frictionally positioned within tracks, with each track located on a respective side wall of the storage unit, such that an external force is needed to move the door along the tracks and over the first and second open walls; and a plate slidably mounted to the storage unit and positioned above the magazine storage area, the plate being generally orthogonal with respect to the door, the plate positioned substantially within the storage unit in a storage position and slidable horizontally outwardly away from the storage unit to a support position to provide a support surface for supporting additional components in the support position, the plate including a knob to allow a user to slide the plate horizontally outwardly away from the storage unit to in the support position, the plate having only one visibly exposed side in the storage position, wherein when the door is slid vertically upwardly to partially cover the first open wall and entirely expose the second open wall, the magazine storage area is still accessible through the first open wall to remove magazines.

2. The storage unit of claim 1, wherein the storage unit has an upper molding generally co-planar with the door and extends around the outer periphery of the storage unit.

* * * * *